US005890563A

United States Patent [19]

Avitan et al.

[11] Patent Number: 5,890,563

[45] **Date of Patent: *Apr. 6, 1999**

[54] LIFT TRUCK MAST HOSE REEVING SYSTEM WITH CHAIN GUIDEWAY

[75] Inventors: Isaac Avitan; Lev M. Bolotin; Robert Weihe, all of Sioux City, Iowa

[73] Assignee: Schaeff, Incorporated, Sioux City, Iowa

[ * ] Notice: This patent issued on a continued prosecution application filed under 37 CFR 1.53(d), and is subject to the twenty year patent term provisions of 35 U.S.C. 154(a)(2).

[21] Appl. No.: 689,508

[22] Filed: Aug. 13, 1996

[51] Int. Cl.[6] ..... B66F 9/06

[52] U.S. Cl. ..... 187/228; 414/631

[58] Field of Search ..... 187/228, 227, 187/226, 229, 222; 414/631, 629

[56] References Cited

U.S. PATENT DOCUMENTS

| | | | |
|---|---|---|---|
| 2,432,411 | 12/1947 | Guemin et al. | 187/228 |
| 4,238,004 | 12/1980 | Olson . | |
| 4,485,894 | 12/1984 | Soule . | |
| 4,592,449 | 6/1986 | Sakata et al. | 187/228 |

*Primary Examiner*—Kenneth Noland
*Attorney, Agent, or Firm*—Natter & Natter

[57] ABSTRACT

Hydraulic hose lines between an inner rail and an adjacent outer rail of a lift truck mast are reeved within a hollow chain guideway. Opposite ends of the chain are fixed to vertical channels; one channel is mounted to the outer rail and the other, to a center support of the inner rail, with the lowermost portion of the chain looped between the channels. The distance between the chain portions seated in each channel provides an unobstructed operator viewing window. Elevating the inner rail causes the chain to progressively separate from the outer rail channel and engage the inner rail channel while lowering of the inner rail causes the chain to separate from the inner rail channel and engage the outer rail channel.

20 Claims, 8 Drawing Sheets

LIFT TRUCK MAST HOSE REEVING SYSTEM WITH CHAIN GUIDEWAY

BACKGROUND OF THE INVENTION

1. Field of the Invention

This invention relates generally to materials handling equipment such as lift trucks and more particularly to mast reeving systems for hydraulic hose lines.

2. Precedent for the Invention

Materials handling equipment and in particular, lift trucks, have constituted specialized application vehicles. Lift trucks were designed to raise, lower and carry materials in a cantilevered arrangement while at the same time, maneuver into extremely tight quarters.

To optimize storage space, warehouse racks were often stacked high and aisles between the racks were narrow. Typical loads were transported to and from warehouses in vehicles ranging from railroad box cars to semi trailers, trucks, vans and smaller vehicles, all of which presented challenging loading and unloading conditions for a typical lift truck. Accordingly, lift trucks have been designed for operating in varied conditions ranging from narrow aisles of high bay storage racks to inside low clearance box cars, semi-trailers and other challenging environments.

Safe operation of lift trucks has been a paramount design consideration. A principal factor in assuring safe lift truck operation in conjunction with load lifting, maneuvering and transport has been to assure operator visibility.

Lift trucks have been traditionally configured with a generally upright forward mast assembly which supported a moveable load carriage. Suitable load engaging attachments, such as forks, were mounted to the carriage. The carriage itself was raised or lowered relative to the mast assembly for lifting a load, for lowering the load to a transport position and for placement of the load in its desired location.

Mast assemblies included at least one rail to which the carriage was mounted for load engagement. Both the carriage and the rail were preferably moveable in a vertical plane, with movement between the carriage and the rail being effected by a hydraulic cylinder and a pair of chains, anchored at one end to the carriage and extending over sheaves.

In order to provide high lift, i.e. the capability of removing and placing loads in high storage racks, lift truck mast assemblies were provided with nested multiple rail stages. For example, lift truck masts with two rails (simplex and duplex), three rails (triplex), and four rails (quadplex) have been employed. Hydraulic cylinders and chains have been employed to effect progressive movement of the plurality of rail stages.

Significant lift truck design considerations related to extending hydraulic hose lines to the carriage elevating cylinder as well as to hydraulic actuated accessories associated with the carriage, such as side shifters, clamps, pushers, etc. It was not uncommon for four or more hydraulic hose lines to be employed for a carriage and accessories.

Safe operation mandated that the hoses not become entangled with one another or with the chains during travel of the mast rails and carriage.

One design approach was the employment of external reeving with hydraulic hose being coiled about large take up reels. The fluid supply line extended to the hub of the reels with the hose being uncoiled as needed to reach the carriage elevating cylinder and carriage accessories. External reeving generally required that hoses extend from the reels, which were mounted to the outside of the outer rail, along the outside of the mast assembly. There was an implicit danger of exposing hose lines to contact with workplace hazards e.g. racks, columns, etc, and/or entangling the lines. Further, oil seals at the reels required frequent inspection and servicing.

Internal reeving, on the other hand, employed a plurality of upper and lower sheaves on adjacent rails. The sheaves rotated about axes which were transverse, i.e., side to side, and were laterally spaced from one another along their axes across the width of the vehicle to avoid entanglement of adjacent lines. The hose runs from each upper sheave to its respective lower sheave were vertical. Unfortunately, the successive vertical hose runs obstructed the operator's forward view, which was framed by the inner rail. Decreased operator visibility was a significant drawback and a major safety consideration with internal reeving.

SUMMARY OF THE INVENTION

A lift truck mast assembly includes a plurality of extensible nested rails with at least one inner rail moveable in a generally vertical plane relative to an adjacent outer rail. Hydraulic hose lines extend to the inner rail for actuation of a center cylinder and accessories associated with a carriage mounted to the inner rail. The hose lines are reeved substantially behind one another in a longitudinal plane within a moveable guideway formed by a hollow chain.

An outer vertical guide bracket is fixed relative to the outer rail and an inner vertical guide bracket is fixed to the inner rail. Opposite ends of the chain are mounted to the tops of each of the brackets. The brackets are laterally spaced from one another, along the width of the lift truck, a distance sufficient to provide an unobstructed operator view window.

Vertical suspended portions of the chain are engaged by each bracket, with links of a lateral portion of the chain spanning between the two brackets. The links are pivotable relative to one another to configure the lateral portion in a curve or loop having a constant radius of curvature, due to the uniform spacing between the brackets.

When the inner rail is elevated, the chain progressively separates from the outer bracket and engages the inner bracket, with successive links from the outer bracket forming the loop of the chain. Lowering of the inner rail causes the chain to separate from the inner bracket and engage the outer bracket while the loop descends.

In applications requiring a greater number of hoses than can be accommodated within the hollow chain, a second chain, mounted to a second pair of vertical brackets, may be employed.

From the foregoing compendium, it will be appreciated that it is an aspect of the present invention to provide a lift truck mast hose reeving system which is not subject to the disadvantages aforementioned.

It is a consideration of the present invention to provide a lift truck mast hose reeving system of the general character described which assures increased safety of lift truck operation.

A feature of the present invention is to provide a lift truck mast hose reeving system of the general character described wherein the possibility of hydraulic hose entanglement is reduced.

Another consideration of the present invention is to provide a lift truck mast hose reeving system of the general character described which assures increased operator visibility.

To provide a lift truck mast hose reeving system of the general character described wherein multiple hydraulic hose lines are grouped behind one another in a moveable guideway is a further aspect of the present invention.

Another consideration of the present invention is to provide a lift truck mast hose reeving system of the general character described wherein a hollow chain is employed for defining the position of vertical runs of hose.

Yet another aspect of the present invention is to provide a lift truck mast hose reeving system of the general character described with a semi-flexible hose guideway.

To provide a lift truck mast hose reeving system of the general character described which precludes hose damage from contact with mast components and/or elements of the workplace environment is a further consideration of the present invention.

Another feature of the present invention is to provide a lift truck mast hose reeving system of the general character described which is both efficient and relatively low in cost.

To provide a lift truck mast hose reeving system of the general character described which is well suited for economical mass production fabrication is a still further feature of the present invention.

Another aspect of the present invention is to provide a lift truck mast hose reeving system of the general character described with both low maintenance requirements and easily serviceable components.

Other aspects, features and considerations of the present invention in part will be obvious and in part will be pointed out hereinafter.

With these ends in view, the invention finds embodiment in the various combinations of elements, arrangements of parts and series of steps by which the said aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings in which are shown some of the various possible exemplary embodiments of the invention.

DESCRIPTION OF THE PREFERRED EMBODIMENTS

Figure 1:
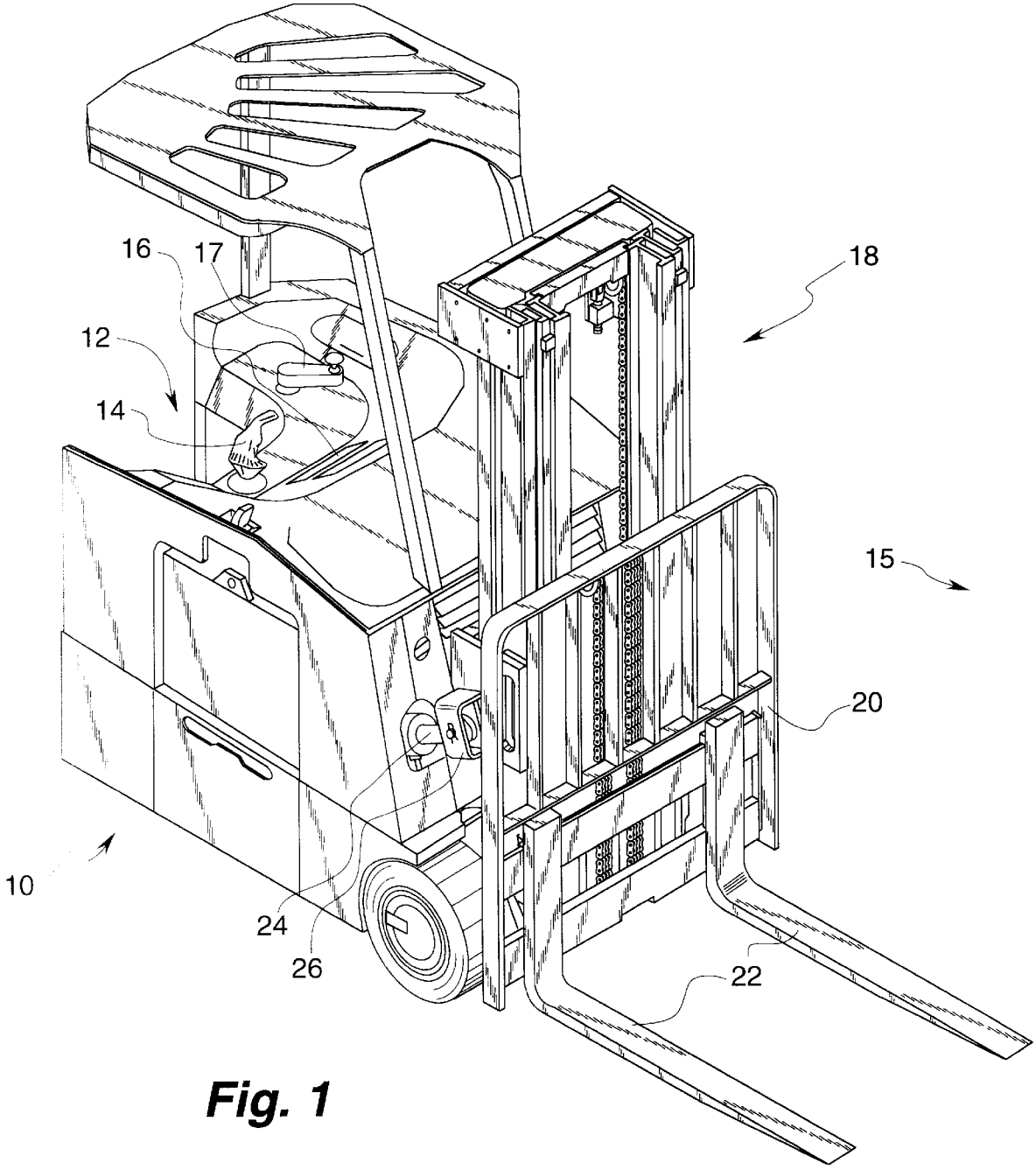
FIG. 1 is a perspective illustration of a typical lift truck with a mast hose receiving system constructed in accordance with and embodying the invention.

Referring now in detail to the drawings, the reference numeral 10 denotes generally a lift truck constructed in accordance with and embodying the invention. The lift truck 10 includes an operator station 12 with suitable multifunction operator controls, for example, a control handle 14, such as, the handle depicted in U.S. Pat. Des. No. 363,330 and a display panel 16, such as, that depicted in U.S. Pat. Des. No. 353,118. Also provided are a pair of forward drive wheels (one of which is illustrated) operated through a speed/direction control 17 and one or more rear steer wheels (not illustrated).

A forward mast assembly 18, comprising a pair of nested rails is employed to engage loads. The mast assembly 18 includes an inner rail, supporting a carriage 20, to which a suitable load engaging attachment such as fork assembly 22 is mounted. In order to enable the load to be tilted rearwardly, the entire mast assembly 18 is pivotable about a lower pivot axis, parallel with the axis of rotation of the front wheels, through a pair of hydraulic tilt cylinders 24. The tilt cylinder ends are pinned to yokes 26 which project laterally from the sides of an outer rail.

An operator, positioned at the operator station 12, utilizes the operator controls to engage a load with the fork assembly 22 or other load engaging attachment, then lift the load by elevating the carriage 20, tilt the load rearwardly by activating the tilt cylinders 24 and move the truck 10 by actuating the speed/direction control 17. For safe operation in a forward direction, indicated by the arrow 15, unobstructed forward operator view is crucial.

Figure 2:
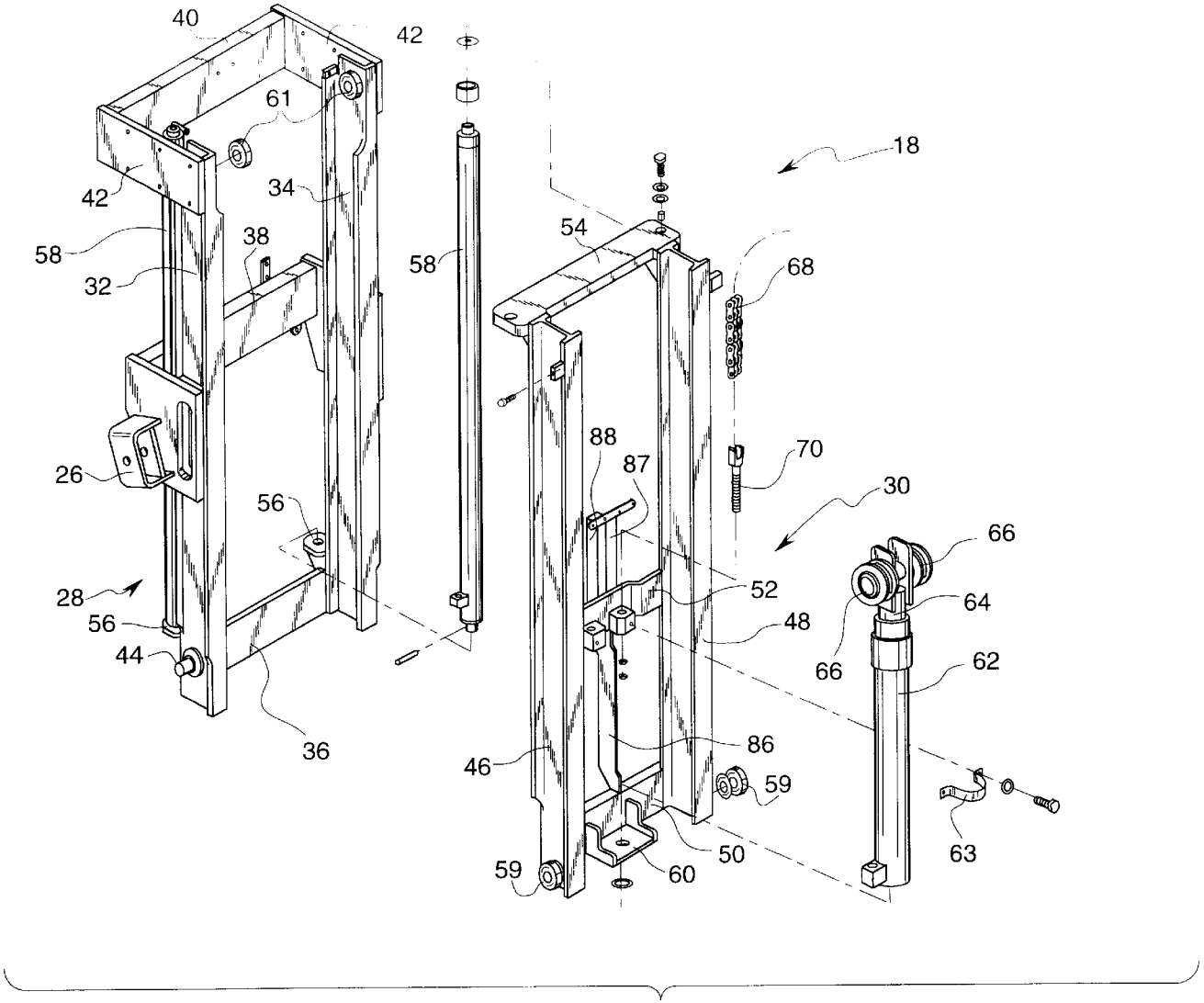
FIG. 2 is an exploded view of a lift truck duplex mast assembly with portions deleted for clarity, and showing the component placement for effecting desired vertical movement of an inner rail and a carriage relative to an outer rail.

With reference now to FIG. 2, which comprises an exploded view of a duplex, i.e., two rail, mast assembly 18, it should be noted that the mast assembly 18 includes an outer rail 28 and an inner rail 30. The outer rail 28 is formed of a pair of spaced, parallel, generally upright columns 32, 34, each having a central planar web lying in a longitudinal plane of the truck 10 and transverse flanges at the longitudinal edges of the webs.

The columns 32, 34 are maintained as a unitary rail in spaced parallel relationship by a lower cross beam 36, a center beam 38 and a header 40, with the header 40 being spaced rearwardly of the columns 32, 34 by a pair of lateral flanges 42. For tilting the mast, the rail 28 is pivotally mounted, with respect to the truck 10, about journals 44 which extend laterally from the columns 32, 34 adjacent the lower ends thereof.

The inner rail 30 comprises a pair of parallel upright columns 46, 48, each formed of a central web and transverse flanges. The columns 46, 48 are maintained in spaced relationship relative to one another by a lower cross beam 50, a center beam 52 and a rearwardly projecting header 54.

A horizontal cylinder support bracket 56 projects rearward from the base of each column 32, 34. The bracket 56 includes a central aperture within which an anchor post projecting from a vertical lift cylinder 58, is received.

It should be appreciated that the inner rail 30 is nested within the outer rail 28 and vertical movement of the inner rail relative to the outer rail is guided by four mast bearings which engage the transverse flanges of the columns. A pair of lower mast bearing 59 are received over a pair of lower outwardly projecting pinions of the columns 46, 48 while a pair of upper mast bearings 61 are received over inwardly projecting pinions adjacent the tops of the columns 32, 34.

With the inner rail 30 nested within the outer rail 28, the horizontal header 54 lies within the vertical plane of the lift cylinders 58. A piston of each lift cylinder 58 is directly engaged with the header 54 and is mounted thereto through a suitable bolt arrangement, illustrated in FIG. 2. Filling or evacuating the lift cylinders 58 thus results in raising or lowering the inner rail 30.

The lower cross beam 50 of the inner rail 30 includes a forwardly projecting cylinder support shelf 60. The support shelf 60 carries a central hydraulic cylinder 62 which is anchored to the inner rail 30 at the support shelf 60 and by a shackle 63 to the center beam.

The cylinder 62 is employed to move the carriage 20 relative to the inner rail 30 and includes a piston 64 which moves vertically, relative to the cylinder 62. The upper end of the piston carries a pair of chain sheaves 66 which rotate about a transverse axle. Each of a pair of chains 68 is anchored, at one end, to a block on the center beam 52 by an adjustable anchor bolt 70. Each chain 68 is wrapped over one of the sheaves 66 and extends downwardly, where it is fixed to the carriage 20.

When the piston 64 moves upward, the carriage 20 will elevate relative to the inner rail 30, hence relative to the mast 18. With the fork assembly 22 engaging a load, the load is lifted by filling the cylinder 62 and lowered by evacuating the cylinder 62.

In order to actuate the cylinder 62, hydraulic hose lines extend from the body of the truck 10 to the cylinder 62. Because the cylinder 62 moves as a unit with the inner rail 30, the hose is required to accordingly move.

Pursuant to the invention, there is provided an internal hose reeving system 72 which assures safe vehicle operation by preserving a relatively large unobstructed operator viewing window in the forward direction 15 as well as tangle-free hose runs which are protected from damage in the work environment.

With reference now to FIGS. 3–6 wherein components of the reeving system 72 are illustrated, it should be noted that a supply line which may comprise a hydraulic hose 74 extends from an operator controlled hydraulic fluid supply system within the truck 10, upwardly adjacent the lift cylinder 58 mounted adjacent the column 32, (FIG. 5) to a distribution manifold 76 which is mounted to the header 40. From the header 40, hydraulic tubing 78 extends downwardly to the base of each lift cylinder 58.

A flexible hydraulic hose 80 extends from the distribution manifold 76 to the base of the cylinder 62. In accordance with the invention, the flexible hydraulic hose 80 is received within a guideway formed by an open hollow chain 82.

The chain 82 comprises a hollow plastic chain with snap open links such as an IGUS Energy Chain, Series 200/240/250, available from Igus, Inc. of East Providence, R.I. Each link of the chain 82 includes parallel end panels each having an integral short hinge pinion and an aperture for receiving the pinion of an adjacent link. The end panels are joined by parallel face panels. The end and face panels define a hollow guideway of rectangular transverse cross section.

Figure 3:
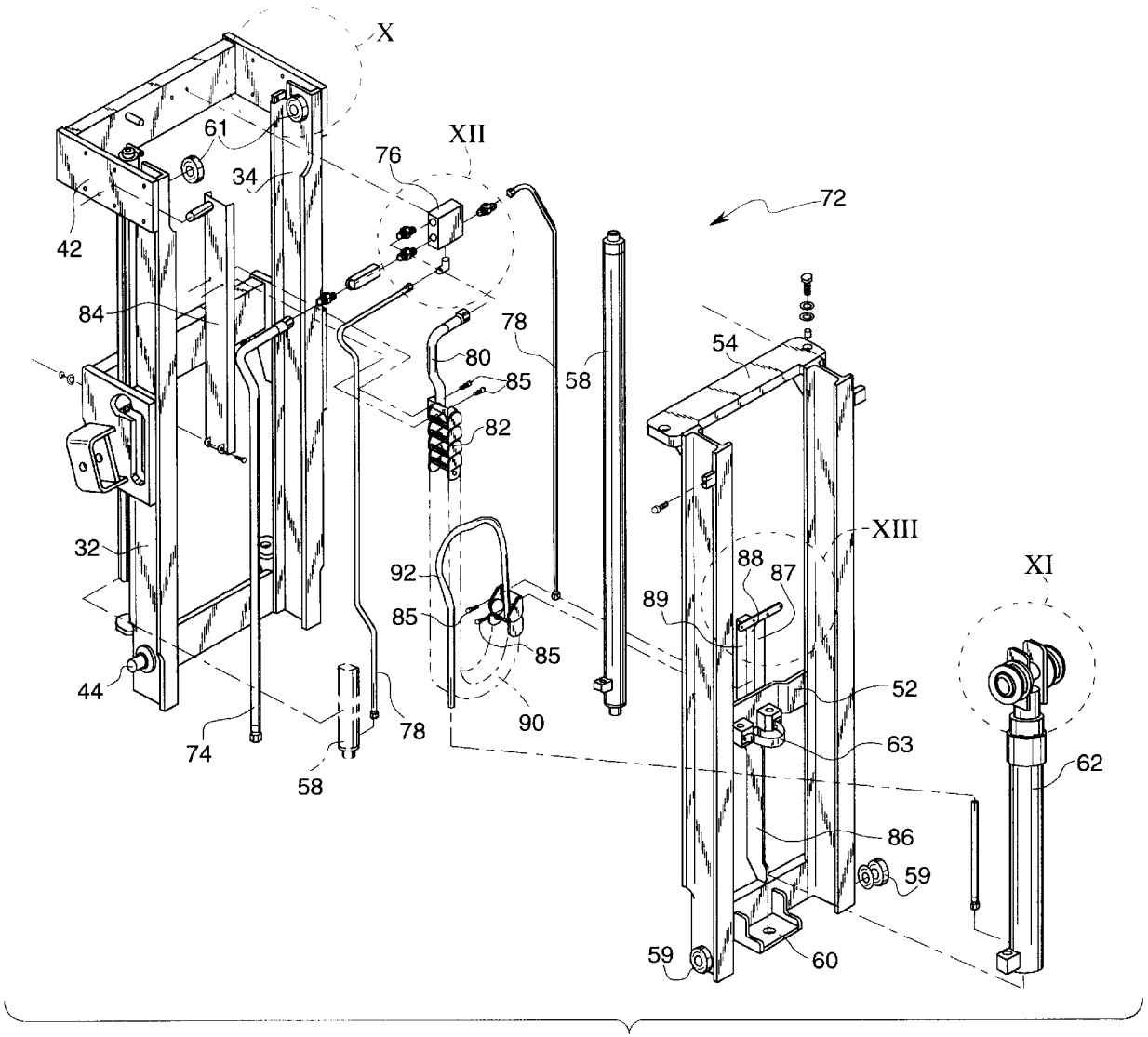
FIG. 3 is a further exploded perspective illustration of the duplex mast assembly illustrating components of a hose reeving system constructed in accordance with and embodying the invention, with elements deleted for clarity and showing a hydraulic hose line hollow chain guideway.

Opposite end links of the chain 82 are anchored to the outer rail 28 and to the inner rail 30. For anchoring the respective ends of the chain, an outer bracket 84, is mounted to the outer rail 28 adjacent the column 32. As illustrated in FIG. 3, the lowermost end of the bracket 84 is anchored by a screw or the like to a tab which projects downwardly from the center beam 38 while the upper end of the bracket 84 is anchored, by a screw or the like, to the lateral flange 42. The bracket 84 is thus positioned immediately adjacent and laterally inwardly of the lift cylinder 58, associated with the column 32.

A central, generally planar, vertical support 86 extends upwardly from the lower cross beam 50 parallel to and between the columns 46, 48 of the inner rail 30. To the support 86, an inner bracket 88, having transverse flanges 87, 89 is mounted. The support 86 is offset laterally from the outer bracket toward the columns 34, 48. From an observation of FIG. 4 it will be seen that the inner bracket 88 is also offset forwardly from the outer bracket 84.

One end of the chain 82 is fixed to the outer bracket 84 by a pair of screws 85 which extend through a rear face panel of a terminal link and into the outer bracket 84. The remaining links are not fixed to the outer bracket 84, which serves merely as a guide. Similarly, the opposite end of the chain 82 is fixed only at its end link to the upper end of the inner bracket 88, by a further pair of screws 85, as illustrated in FIG. 3.

The chain 82 includes two vertical portions, suspended from the end links and engaging the brackets 84, 88 and a lateral portion between the vertical portions. In the lateral portion, the unsupported links of the chain pivot about one another in a curve or loop 90.

When the inner rail 30 moves upwardly relative to the outer rail 28, successive lowermost links of the chain part from the outer bracket 84 and form the loop 90 while successive links of the loop 90 engage the inner bracket 88 and move upwardly with the inner rail 30. The outer bracket 84 and the inner bracket 88 are always parallel to one another and the distance between the vertical runs of chain which engage the respective brackets remains constant. As a result, the looped portion 90 of the chain 82 maintains a constant radius of curvature although it ascends when the inner rail is elevated and descends when the inner rail is lowered.

Figure 4:
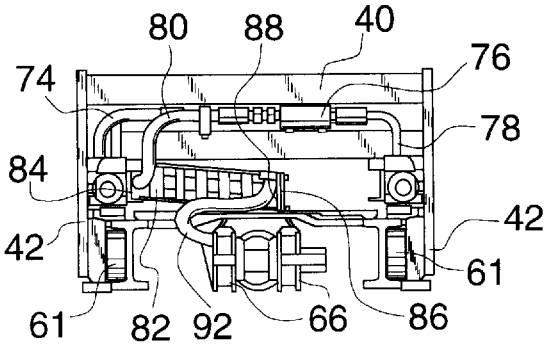
FIG. 4 is a top plan view of the duplex mast.
Figure 5:
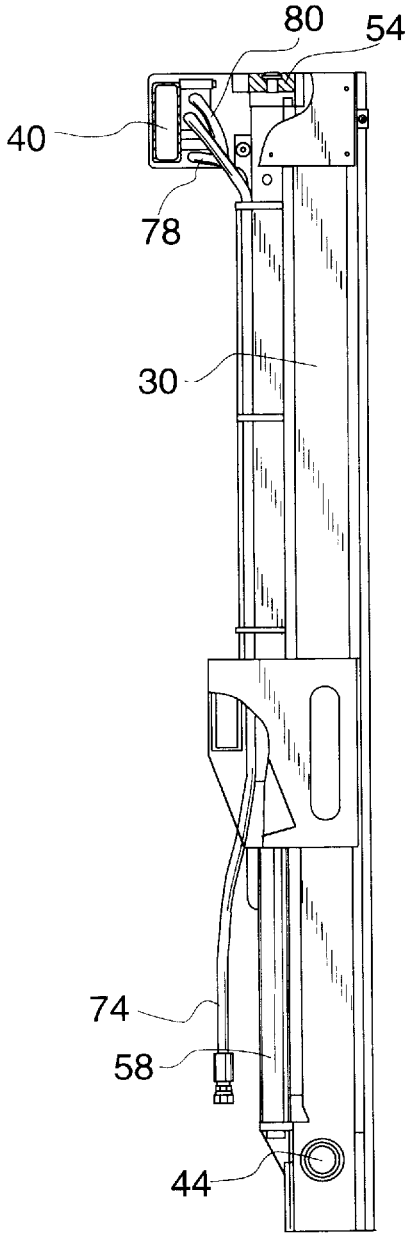
FIG. 5 is a side elevational view thereof, with portions broken away.

An exposed end length 92 of the hydraulic hose 80 extends from the end of the hollow chain 82 fixed to the inner bracket 88 and is looped over the top of the inner rail center beam 52 and downwardly to the base of the cylinder 62, where it is hydraulicly coupled to the interior of the cylinder 62. Suitable ties are employed to secure the exposed hose portion 92 in proper orientation, as illustrated in FIGS. 4 and 6.

Figure 6:
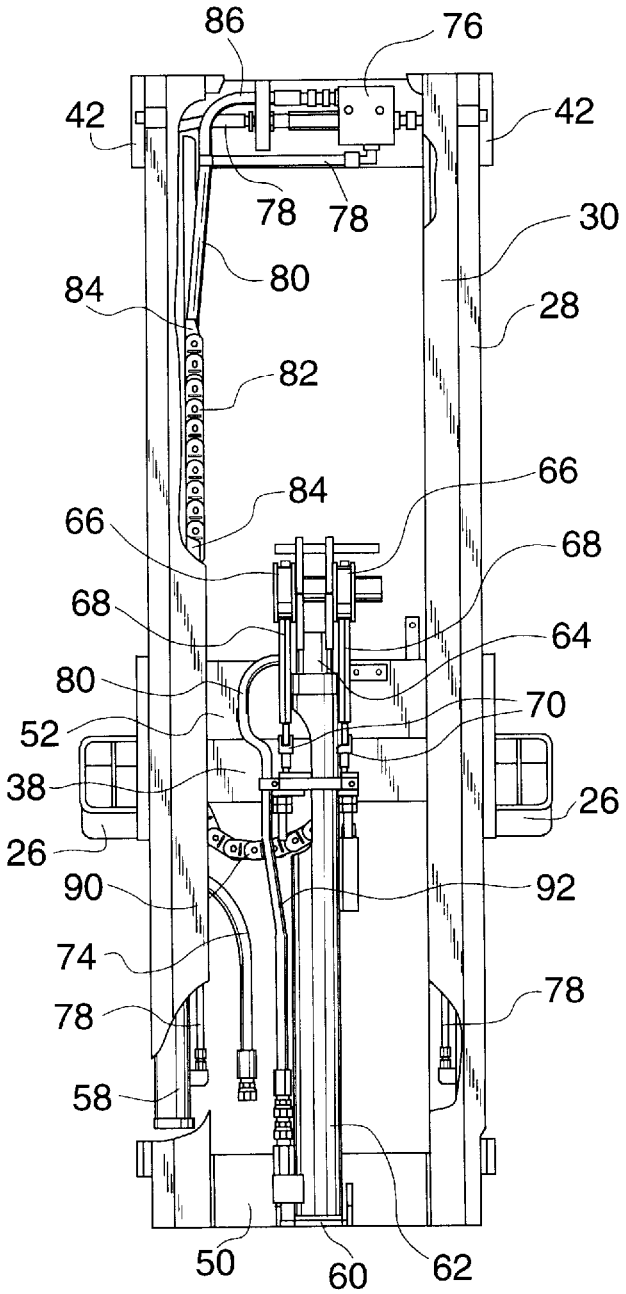
FIG. 6 is a front elevational view thereof, with portions broken away for the purpose of illustration.

From an examination of FIG. 6, it will be observed that the vertical run of the hollow chain 82 which engages the outer bracket 84 is positioned entirely behind the transverse flanges of the inner rail column 46. Thus, the reeving system 72 results in no reduction of the width of the operator view window which is framed by the inner rail.

FIG. 6 illustrates the mast assembly 18 with the carriage down and the piston 64 of the cylinder 62 in its lowermost position. When the piston raises to elevate the carriage, the operator view window is reduced by the piston and the chains. After the carriage attains its maximum elevation relative to the inner rail 30, the lift cylinders 58 elevate the inner rail and the operator view window is reduced by the width of the cylinder 62. Because the vertical run of the chain 82 engaging the inner bracket 88 is positioned entirely behind the cylinder 62, no portion of the chain will obstruct the operator view window between the inner rail column 46 and the cylinder 62.

Additional hose lines are required in order to operate various accessories which may be associated with the carriage 20. Among the accessories customarily employed are hydraulic side shifter mechanisms, rotators, push/pulls and clamps, such as, carton clamps, paper roll clamps, bale clamps, etc. Many accessory applications require more hydraulic hose lines than can be accommodated in a single hollow chain 82.

An alternate embodiment of the reeving system, illustrated in FIGS. 7 through 13, is configured for multiple auxiliary hydraulic hose applications. In the description of this embodiment, like numerals will be employed to denote like components of the prior embodiment, however, bearing the suffix "a".

A duplex mast assembly 18*a* substantially identical to the mast assembly 18 depicted in FIG. 2 is provided with a reeving system 72*a* configured to accommodate four hydraulic hose lines, in addition to a hose line 80*a* for actuating a cylinder 62*a*.

A hydraulic supply line 74*a* 499 extends from a fluid supply system of a lift truck in a path identical to that of the line 74 of the prior embodiment. There is additionally provided, however, four more auxiliary hose lines, 94*a*, 96*a*, 98*a* and 100*a* which extend across an outer rail 28*a* from a column 34*a* to a column 32*a* and upwardly across an outer rail header 40*a*.

Figure 12:
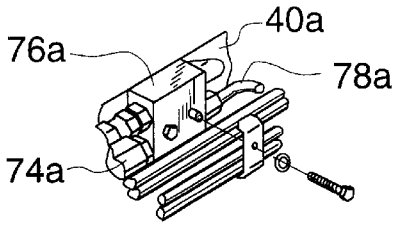
FIG. 12 is a fragmentary perspective partial view of auxiliary hose routing of the embodiment of FIG. 7, as if having been taken at a circle XII of FIG. 3, if same were configured with the auxiliary chain.
Figure 13:
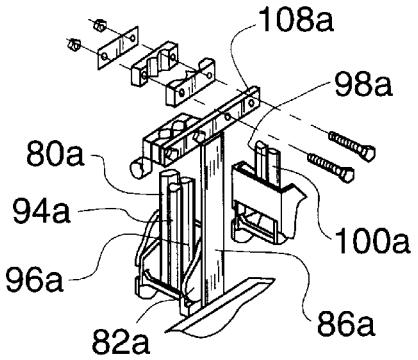
FIG. 13 is a partial fragmentary perspective illustration of hydraulic hose routing at the inner rail ends of the chains, the same as if having been taken at the circle XIII of FIG. 3, if same were configured with the auxiliary chain.

The supply line 74*a* extends into a distribution manifold 76*a* in a manner identical to that of the prior embodiment, and as depicted in FIG. 12. From the manifold 76*a*, a pair of tubing lines 78*a* extend to a pair of cylinders 58*a* and a flexible hydraulic hose 80*a* extends to the cylinder 62*a* through a hollow chain 82*a* identical to the chain 82 previously described.

Efficiently threaded through the chain 82*a* are two of the auxiliary hose lines, 94*a* and 96*a*. In order to accommodate the hose lines 98*a* and 100*a*, a second hollow chain 102*a* is provided, identical in mechanical configuration to the chain 82*a* but with links of different size so that the hollow guideway formed by the links is of different dimensions in rectangular cross section with different hose capacities than the chain 82*a*.

The hollow chain 102*a* is mounted, at one end, to an outer bracket 104*a* which, in turn, is fixed to the outer rail 28*a* adjacent a rail column 34*a*, in a manner substantially identical to that of the outer bracket 84 of the prior embodiment.

The hollow chain 102*a* is engaged, at its opposite end, in an inner bracket 106*a* which is fixed to a vertical bracket support 86*a* in back to back relationship with the inner bracket 88*a*.

Figure 7:
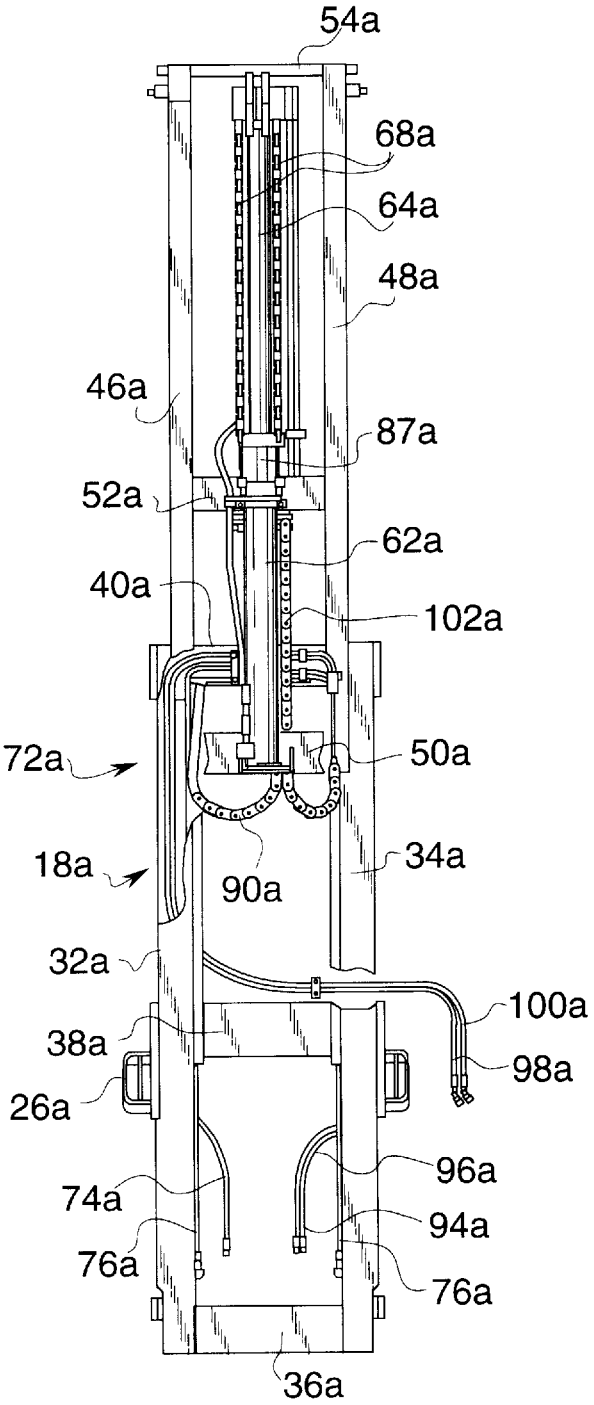
FIG. 7 is a front elevational view of an alternate embodiment of the duplex mast assembly with an inner mast and a carriage fully elevated wherein an auxiliary hollow chain guideway is provided for additional hydraulic hose lines required for operation of accessories, with portions of the mast broken away for the purpose of illustration.
Figure 8:
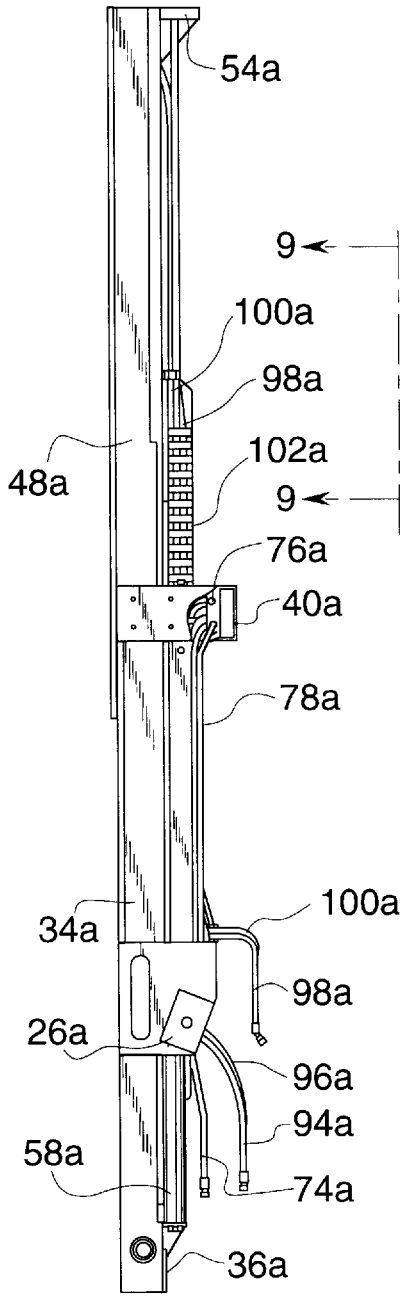
FIG. 8 is a side elevational view of the duplex mast assembly shown in FIG. 7, with portions broken away for the purpose of illustration.

It will be noted, from an examination of FIG. 7 wherein an inner rail 30*a* is shown in a fully elevated position, that a bracket support 86*a* is located slightly offset from the center, that is, it is positioned closer to an inner rail column 48*a* than to an inner rail column 46*a*. This accommodates the different radius of curvature of a looped lateral portion of the chain 102*a*. Such radius differs because of the difference in the size of the links of the hollow chain 102*a* as compared with the hollow chain 82*a*. Although portions of the chain 102*a* engaging the bracket 106*a* project into the space between the inner rail column 48*a* and the cylinder 62*a*, on the operator's right side, the view window remains unobstructed.

Figure 9:
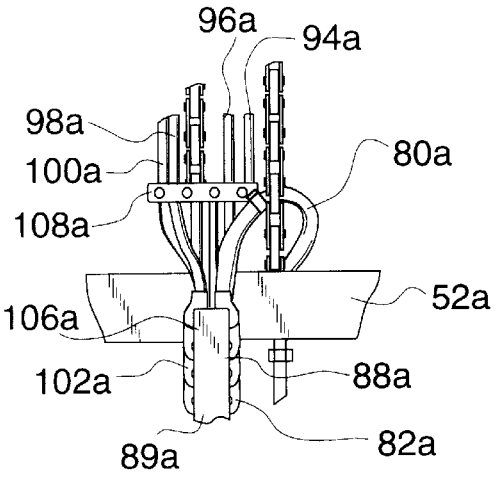
FIG. 9 is an enlarged scale fragmentary auxiliary view of the FIG. 7 embodiment, taken substantially along the plane 9—9 of FIG. 8 and showing hydraulic hose routing from the ends of the hollow chain guideways which are fixed to the inner rail.
Figure 10:
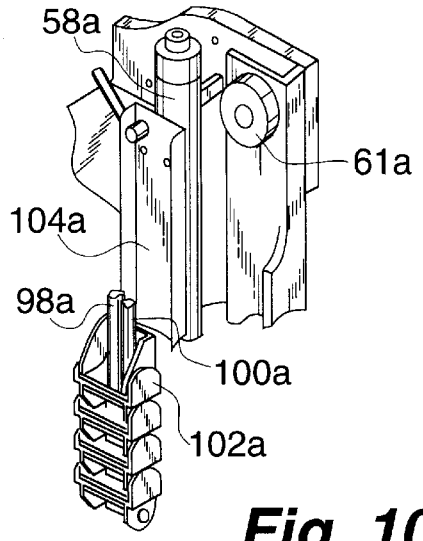
FIG. 10 is an enlarged scale fragmentary exploded partial view of the manner of anchoring an end of the auxiliary hollow chain to a bracket fixed to an outer rail, the same being taken from a view at a circle X of FIG. 3, if same were configured with the auxiliary hollow chain.
Figure 11:
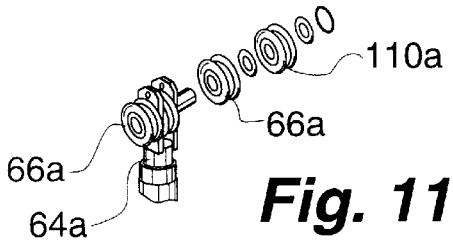
FIG. 11 is a fragmentary exploded partial perspective illustration of an auxiliary hose reeving sheave, the same being taken from a view at a circle XI of FIG. 3 if same were configured with the auxiliary hollow chain.

Referring now in greater detail to FIG. 9, it will be seen that at the inner rail end of the hollow chains 82*a*, 102*a*, the flexible hydraulic hose 80*a* which feeds the cylinder 62*a*, extends over an inner cylinder center beam 52*a* and downwardly to the base of the cylinder 62*a* in a manner identical to that of the previous embodiment.

The auxiliary hose lines 94*a*, 96*a*, 98*a* and 100*a*, however, are suitably tied to a brace 108*a* and extend upwardly over and across an auxiliary hose sheave 110*a* (FIG. 11) which rotates on a common shaft with a pair of chain sheaves 66*a* at the upper end of a piston 64*a*. From the hose sheave 110*a*, the auxiliary hose lines 94*a*, 96*a*, 98*a* and 100*a* extend downwardly to hydraulic connection fittings of their associated carriage accessories.

Figure 14:
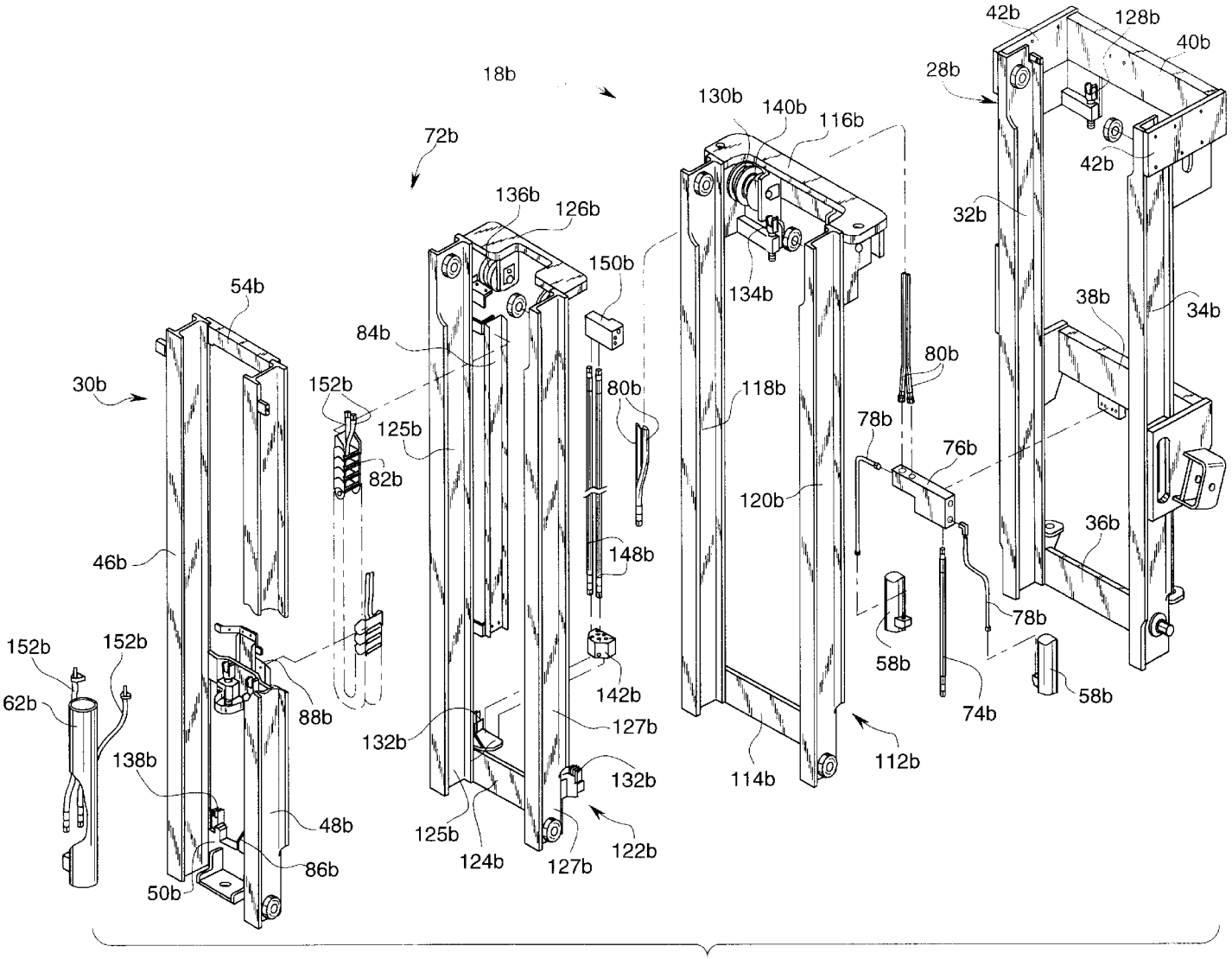
FIG. 14 is an exploded perspective illustration of a lift truck quadplex mast assembly having a hose reeving system constructed in accordance with and embodying the invention and illustrating a hollow chain guideway for hose runs extending between the inner forward rail and the next adjacent outer rail, and FIG. 15 comprises an exploded perspective view of an alternate embodiment of the quadplex mast assembly wherein auxiliary hoses are carried within an auxiliary hollow chain guideway.
Figure 15:
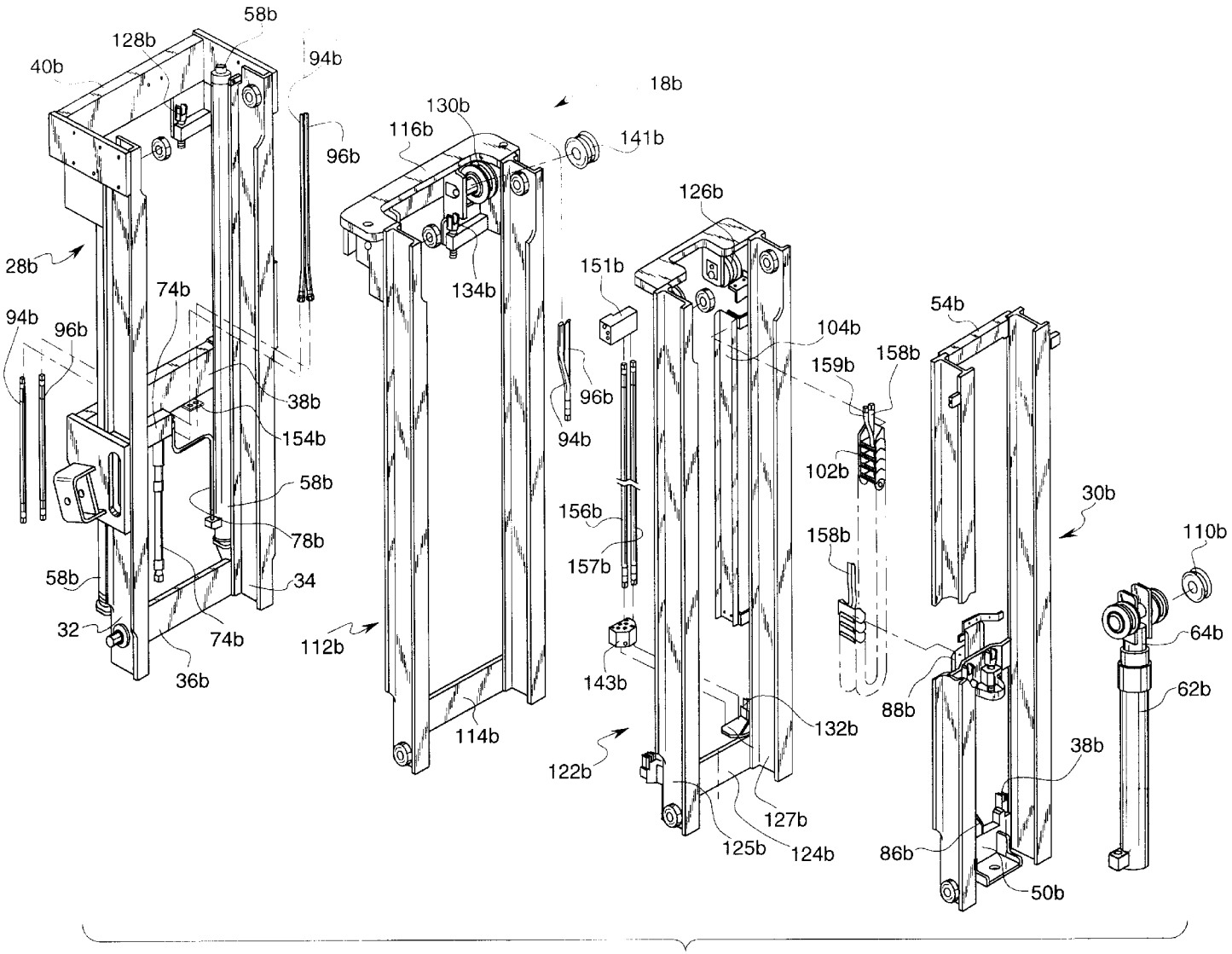

A further embodiment of the reeving system is illustrated in FIGS. 14 through 15 wherein a quadplex mast assembly is shown. In this embodiment, like numerals will be employed to denote like components of the prior embodiment however, being the suffix "b". It should be noted that a quadplex mast assembly 18*b* includes a first outermost rail 28*b*, similar in configuration to the outer rail 28 of the first embodiment, and a second outer rail 112*b* having a lower cross beam 114*b* and a header 116*b* which join a pair of columns, 118*b*, 120*b*. The mast assembly 18*b* also includes a third outer rail 122*b* having a lower cross beam 124*b* and a header 126*b* which join a pair of columns 125*b*, 127*b* and also an inner rail 30*b* having a pair of columns 46*b*, 48*b*, a lower cross beam 50*b* and a header 54*b*.

The inner rail 30*b* is nested within the third outer rail 122*b* which, in turn, is nested within the second outer rail 112*b* which, in turn, is nested within the first outermost rail 28*b*.

Vertical movement of the second outer rail 112*b* relative to the first outermost rail 28*b* is effected by a pair of lift cylinders 58*b* which are positioned behind a pair of columns 32*b*, 34*b* of the first outermost rail 28*b* and which engage the header 116*b* of the second outer rail 112*b*.

Vertical movement of the third outer rail 122*b* and the inner rail 30*b* is effected by two chain stages. Each chain of a first chain pair (not illustrated) is anchored at one end a header 40*b* of the first outermost rail 28*b* at an anchor bolt 128*b* and extends over a chain sheave 130*b* carried on about a transverse axis beneath the header 116*b* of the second outer rail 112*b*. From the sheave 130*b*, the chain extends to an anchor 132*b* which projects rearwardly from the third outer rail 122*b*.

It should be appreciated that the chain pair arrangement is symmetric and, the identical arrangement is provided for the opposite columns of the rails as depicted in FIGS. 14 and 15.

With reference again to FIG. 14, it should be appreciated that each chain of a second stage chain pair (not illustrated) is anchored at one end to an anchor bolt 134*b* fixed to a flange of the second outer rail header 116*b*. The chain extends over a sheave 136*b* which rotates about a transverse axis beneath the third outer rail header 126*b*, with the end of the chain being fixed to an anchor 138*b* at a lower cross beam 50*b* of the inner rail 30*b*.

With attention directed again to FIG. 14, wherein a hose reeving system 72*b* constructed in accordance with the invention is shown for supplying a cylinder 62*b*, it should be noted that a supply hose 74*b* extends from an operator controlled hydraulic fluid supply system within a truck to a distribution manifold 76*b* which is mounted to a center beam 38*b* of the first outermost rail 28*b*. From the manifold, hydraulic tubing lines 78*b* extend downwardly to the base of each of the lift cylinders 58*b* which engage the header 116*b* of the second outer rail 112*b*.

A pair of flexible hydraulic hoses 80*b* extend upwardly from the manifold 76*b* and pass over a hose sheave 140*b* which rotates about the same transverse axis as the chain sheave 30*b*. From the sheave 140*b*, the hose lines 80*b* extend downwardly to a lower manifold 142*b* which is secured to a bracket extending rearwardly from the third outer rail 122*b*, adjacent the anchor 132*b*.

From the manifold 142*b*, a vertical run of twin hose lines 148*b* extend upwardly to an upper distribution manifold 150*b* which is mounted to the third outer rail 122*b* beneath the chain sheave 136*b*.

From the upper manifold 150*b*, fluid supply to the cylinder 62*b* extends through a further pair of twin flexible hose lines, 152*b* which are carried within a hollow chain 82*b*, substantially identical to the chain 82 of the prior embodiment. One end of the chain 82*b* is secured to an outer bracket 84*b* which, is mounted in vertical position parallel to and behind the column 125*b* of the third outer rail. The bracket 84*b* is positioned such that it is spaced laterally inwardly of the vertical run of the twin hose lines 148*b*.

The opposite end of the hollow chain 82*b* is secured to an inner bracket 88*b* which is fixed to a support 86*b* on the inner rail 30*b*. From the inner rail end of the chain 82*b*, the twin hose lines 152*b* are suitably tied and extend down to hydraulic fittings at the base of the cylinder 62*b*.

With reference now to FIG. 15, it will be seen that the reeving system 172*b* also accommodates auxiliary hose lines for carriage accessories. Illustrated in FIG. 15 are a pair of auxiliary hose lines 94*b*, 96*b* which extend from a suitable hydraulic supply within the truck. The hose lines 94*b*, 96*b* pass through a support bracket/coupling 154*b* on the center beam 38*b* of the first outermost rail 28*b*.

From the bracket/coupling 154*b*, the hose lines 94*b*, 96*b* extend in vertical runs upwardly and pass over a hose sheave 141*b* substantially identical to the hose sheave 140*b* described with reference to the hose lines 80*b*. From the sheave 141*b*, the hose lines 94*b*, 96*b* descend in a vertical run to a lower distribution manifold 143*b*, which is the mirror image of the distribution manifold 143*b* described with reference to the hoses 80*b*. The manifold 143*b* is mounted to the third outer rail 122*b* behind the column 127*b*.

From the lower manifold 143*b*, hydraulic fluid supply to the carriage accessories extends through a vertical run of a pair of hose lines, 156*b*, 157*b* to an upper manifold 151*b*, substantially identical to yet the mirror image of the manifold 150*b* previously described. From the manifold 151*b*, fluid supply extends through a further pair of hydraulic hose lines 158*b*, 159*b* which extend through a guideway formed by a hollow chain, 102*b*, substantially identical to the hollow chains described in the previous embodiments but which may have links of a different size than the links of the hollow chain 82*b*.

The hollow chain 102*b* is fixed, at one end, to an outer bracket 104*b* which is mounted behind the column 127*b* of the third outer rail 122*b*. The opposite end of the hollow chain 102*b* is fixed to an inner bracket 106*b* which is secured to the support 86*b*. From the inner rail end of the hollow chain 102*b*, the hydraulic hose lines 158*b*, 159*b* extend over a hose sheave 110*b* on the end of a piston 64*b* of the cylinder 62*b* and downwardly to fittings on hydraulicly actuated carriage accessories.

It will be noted that the reeving systems 72, 72*a* and 72*b* are effected through the use of a guideway formed by a hollow chain which guideway interconnects the hose lines between an inner rail and an adjacent outer rail which is in engagement with the inner rail. For example, in a duplex mast assembly, the chain guideway is provided for the hoses interconnecting each of the rails while in a quadplex mast, the chain guideway is provided between the inner rail, which carries the carriage actuating cylinder and its next adjacent rail, i.e., the third outer rail. The chain guideway may be employed for hose reeving between any two adjacent intergaged rails.

Thus it will be seen that there is provided a lift truck mast hose reeving system which achieves the various aspects, features and considerations of the present invention and which is well suited to meet the conditions of practical usage.

Since various possible embodiments might be made of the present invention and various changes might be made of the exemplary embodiments set forth herein without departing from the spirit of the invention, it is to be understood that all matter herein described or shown in the accompanying drawings is to be interpreted as illustrative and not in a limiting sense.

Having thus described the invention there is claimed as new and desired to be secured by Letters Patent:

1. A mast assembly for a materials handling vehicle, the mast assembly including an inner rail, the inner rail having a pair of parallel columns, an outer rail, the outer rail having a pair of parallel columns, the inner rail being engaged in the outer rail for movement relative thereto, a hydraulic line extending to the inner rail, the line having a pair of ends, one end of the line being fixed relative to the vehicle and the other end of the line being fixed relative to the inner rail, at least a portion of the line comprising a flexible hose, the flexible hose extending to the inner rail and means for reeving the flexible hose between the inner rail and the outer rail, the means for reeving comprising a hollow chain, the hollow chain including a plurality of links, means for pivoting the links relative to one another, the hollow chain defining a guideway, the flexible hose being positioned within the guideway, the hollow chain having a pair of ends, means fixing one end of the chain to the outer rail and means fixing the other end of the chain to the inner rail.

2. A mast assembly for a materials handling vehicle as constructed in accordance with claim 1 wherein the means fixing one end of the chain to the outer rail and the means fixing the other end of the chain to the inner rail includes means fixing the one end of the chain to the outer rail adjacent one of the outer rail columns, the means fixing the other end of the chain to the inner rail being spaced laterally from the one end in a direction toward the other column of the outer rail.

3. A mast assembly for a materials handling vehicle as constructed in accordance with claim 2 wherein the means fixing the other end of the chain to the inner rail is positioned forwardly of the means fixing the one end of the chain to the outer rail.

4. A mast assembly for a materials handling vehicle as constructed in accordance with claim 2 wherein a plurality of links of the chain span the lateral distance between the ends of the chain, each link of the plurality of links being pivoted with respect to an adjacent link to form a curve.

5. A mast assembly for a materials handling vehicle as constructed in accordance with claim 1 further including a pair of chain brackets, one of the chain brackets being fixed to the outer rail and the other chain bracket being fixed to the inner rail, the one end of the chain being fixed to the one chain bracket and the other end of the chain being fixed to the other chain bracket.

6. A mast assembly for a materials handling vehicle as constructed in accordance with claim 1 further including a hydraulic cylinder, means supporting the cylinder from the inner rail and means connecting the other end of the hydraulic line to the cylinder.

7. A mast assembly for a materials handling vehicle as constructed in accordance with claim 6, the mast assembly including a carriage, means mounting the carriage to the inner rail for movement relative thereto and means operatively interconnecting the cylinder and the carriage.

8. A mast assembly for a materials handling vehicle as constructed in accordance with claim 1 including a further hydraulic line, at least a portion of the further hydraulic line comprising a flexible hose extending from the outer rail to the inner rail and further means for reeving the further hydraulic line flexible hose, the further means for reeving comprising a further hollow chain having a pair of ends, means for fixing one end of the further chain to the outer rail and means for fixing the other end of the further chain to the inner rail, the chain defining a further guideway, the further hydraulic line flexible hose being carried within the further guideway.

9. A mast assembly for a materials handling vehicle as constructed in accordance with claim 8 wherein the further hollow chain carries a plurality of flexible hoses.

10. A mast assemble for a materials handling vehicle as constructed in accordance with claim 1 wherein the hollow chain carries a plurality of flexible hoses.

11. A mast assembly for a materials handling vehicle as constructed in accordance with claim 1, wherein the materials handling vehicle comprises a lift truck.

12. A mast assembly for a materials handling vehicle as constructed in accordance with claim 1, further including an additional outer rail, the outer rail being engaged in the additional outer rail for movement relative thereto, the hydraulic line extending from the additional outer rail to the outer rail and from the outer rail to the inner rail.

13. A mast assembly for a materials handling vehicle as constructed in accordance with claim 12 further including an outermost rail, the additional outer rail being engaged in the outermost rail for movement relative thereto, the hydraulic line extending from the outermost rail to the additional outer rail, from the additonal outer rail to the outer rail and from the outer rail to the inner rail.

14. A mast assembly for a materials handling vehicle as constructed in accordance with claim 1 wherein the hollow chain is vertically suspended from each of its ends.

15. A mast assembly as constructed in accordance with claim 1 in combination with materials handling equipment, the materials handling equipment comprising a lift truck.

16. A hose reeving system for hydraulic hose extending between a pair of interengaged rails of materials handling equipment, the hose reeving system comprising a chain, the chain including a plurality of interengaged links, each link having a pair of spaced parallel end panels joined by a pair of spaced parallel face panels, the end panels and the face panels defining a hollow guideway, means pivotally interconnecting successive links of the chain, a hydraulic hose, the hose being carried in the guideway, means for aligning the links of a portion of the chain adjacent one end in substantially a first plane, means for aligning links of a portion of the chain adjacent the other end in substantially a second plane, the first plane and the second plane being spaced from one another to provide unobstructed operator view, a lateral portion of the chain extending between the planes, means for configuring the lateral portion of the chain in a curve, successive links of the chain separating from the first plane and forming the lateral portion and successive links of the lateral portion separating from the lateral portion and lying in the second plane when the rails are moved relative to one another in one direction, successive links of the second plane separating from the second plane and forming the lateral portion, successive links of the lateral portion separating from the lateral portion and lying within the first plane when the rails are moved relative to one another in the opposite direction.

17. A reeving system for hydraulic hose extending between a pair of interengaged rails of materials handling equipment as constructed in accordance with claim 16 wherein the means pivotally interconnecting successive links comprises means forming a hinge pinion in each of the end panels and means forming an aperture in each of the end panels for receiving the hinge pinion of an adjacent link.

18. A hose reeving system for hydraulic hose extending between a pair of interengaged rails of materials handling equipment as constructed in accordance with claim 16 further including means for configuring the lateral portion of the chain in a curve, the curve having a constant radius of curvature irespective of the position of the rails relative to one another.

19. A hose reeving system for hydraulic hose extending between a pair of interengaged rails of materials handling equipment as constructed in accordance with claim 16 wherein the means for aligning links at the one end comprises a first bracket, means fixing the one end of the chain to the first bracket, the means for aligning links at the other end comprising a second bracket and means fixing the other end of the chain to the second bracket.

20. A hose reeving system for hydraulic hose extending between a pair of interengaged rails of materials handling equipment as constructed in accordance with claim 19 wherein each of the brackets is mounted in a vertical position.

* * * * *